US009388664B2

(12) United States Patent
Teale et al.

(10) Patent No.: US 9,388,664 B2
(45) Date of Patent: Jul. 12, 2016

(54) HYDRAULIC SYSTEM AND METHOD OF ACTUATING A PLURALITY OF TOOLS

(71) Applicants: David Teale, Spring, TX (US); Robert Scott Rees, Houston, TX (US)

(72) Inventors: David Teale, Spring, TX (US); Robert Scott Rees, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 338 days.

(21) Appl. No.: 13/929,298

(22) Filed: Jun. 27, 2013

(65) Prior Publication Data

US 2015/0000928 A1 Jan. 1, 2015

(51) Int. Cl.
*E21B 34/10* (2006.01)

(52) U.S. Cl.
CPC ..... *E21B 34/10* (2013.01)

(58) Field of Classification Search
CPC ..... E21B 34/10; E21B 34/103; E21B 34/108; E21B 23/006
See application file for complete search history.

(56) References Cited

U.S. PATENT DOCUMENTS

| | | | | |
|---|---|---|---|---|
| 4,042,033 | A * | 8/1977 | Holland et al. | 166/310 |
| 5,156,207 | A | 10/1992 | Haugen et al. | |
| 5,547,029 | A * | 8/1996 | Rubbo et al. | 166/375 |
| 6,237,701 | B1 | 5/2001 | Kolle et al. | |
| 6,516,888 | B1 * | 2/2003 | Gunnarson et al. | 166/373 |
| 6,567,013 | B1 * | 5/2003 | Purkis et al. | 340/854.3 |
| 6,745,838 | B2 | 6/2004 | Watson | |
| 7,025,146 | B2 | 4/2006 | King et al. | |
| 7,198,099 | B2 | 4/2007 | Lugtmeier et al. | |
| 7,464,761 | B2 | 12/2008 | Hosatte et al. | |
| 7,503,385 | B2 | 3/2009 | Tips et al. | |
| 7,516,792 | B2 | 4/2009 | Lonnes et al. | |
| 7,708,075 | B2 | 5/2010 | Lake et al. | |
| 7,730,953 | B2 | 6/2010 | Casciaro | |
| 7,735,557 | B2 | 6/2010 | Mailand et al. | |
| 7,861,786 | B2 | 1/2011 | Hill, Jr. et al. | |
| 7,934,550 | B2 | 5/2011 | Bolding et al. | |
| 7,980,315 | B2 | 7/2011 | Bolding et al. | |
| 8,016,035 | B2 | 9/2011 | Strattan et al. | |
| 8,286,709 | B2 | 10/2012 | Mennem et al. | |
| 8,347,916 | B2 | 1/2013 | June | |
| 8,408,314 | B2 * | 4/2013 | Patel et al. | 166/373 |
| 8,893,787 | B2 * | 11/2014 | Tips et al. | 166/268 |
| 8,893,799 | B2 * | 11/2014 | Garay | 166/332.6 |
| 9,062,518 | B2 * | 6/2015 | Patel et al. | |
| 2001/0037884 | A1 * | 11/2001 | Schultz et al. | 166/378 |
| 2002/0014338 | A1 * | 2/2002 | Purkis et al. | 166/375 |
| 2002/0027003 | A1 * | 3/2002 | Williamson et al. | 166/240 |
| 2002/0053438 | A1 * | 5/2002 | Williamson, Jr. | 166/373 |

(Continued)

FOREIGN PATENT DOCUMENTS

GB 2484692 A * 4/2012

OTHER PUBLICATIONS

Notification of Transmittal of the International Search Report of the International Searching Authority, or the Declaration; PCT/US2014/039071; Sep. 23, 2014; 5 pages.

(Continued)

*Primary Examiner* — Jennifer H Gay
(74) *Attorney, Agent, or Firm* — Cantor Colburn LLP

(57) ABSTRACT

A hydraulic system includes a chemical injection line and a plurality of tools in operable communication with the chemical injection line that are independently responsive to changes in pressure or flow through the chemical injection line and that are configured to control flow of wellbore fluids.

26 Claims, 2 Drawing Sheets

(56) References Cited

U.S. PATENT DOCUMENTS

| | | | | |
|---|---|---|---|---|
| 2005/0098210 | A1* | 5/2005 | Strattan et al. | 137/70 |
| 2006/0021750 | A1* | 2/2006 | Lugtmeier et al. | 166/169 |
| 2006/0254763 | A1* | 11/2006 | Tips et al. | 166/65.1 |
| 2006/0278399 | A1* | 12/2006 | Dwivedi et al. | 166/375 |
| 2007/0163774 | A1* | 7/2007 | Hosatte et al. | 166/66.6 |
| 2007/0181313 | A1* | 8/2007 | Churchill | 166/374 |
| 2009/0044937 | A1 | 2/2009 | Purkis | |
| 2009/0065218 | A1* | 3/2009 | Loretz et al. | 166/375 |
| 2009/0218102 | A1* | 9/2009 | Casciaro | 166/321 |
| 2009/0294123 | A1* | 12/2009 | Mescall et al. | 166/250.01 |
| 2009/0294133 | A1 | 12/2009 | Shindgikar et al. | |
| 2010/0038093 | A1* | 2/2010 | Patel | 166/375 |
| 2010/0059233 | A1* | 3/2010 | Smithson et al. | 166/385 |
| 2010/0101788 | A1 | 4/2010 | Mennem et al. | |
| 2010/0108320 | A1* | 5/2010 | Larnach | 166/310 |
| 2010/0236790 | A1* | 9/2010 | Smithson | 166/373 |
| 2010/0237698 | A1* | 9/2010 | Smithson | 307/38 |
| 2011/0061875 | A1* | 3/2011 | Tips et al. | 166/373 |
| 2011/0079398 | A1 | 4/2011 | Patel et al. | |
| 2011/0192480 | A1* | 8/2011 | Willauer et al. | 137/637 |
| 2011/0210609 | A1* | 9/2011 | Smithson et al. | 307/38 |
| 2012/0168174 | A1* | 7/2012 | Vaghi et al. | 166/373 |
| 2012/0318367 | A1 | 12/2012 | Going et al. | |
| 2012/0325493 | A1* | 12/2012 | Rees et al. | 166/373 |
| 2013/0048303 | A1 | 2/2013 | Patel et al. | |
| 2015/0000928 | A1* | 1/2015 | Teale et al. | 166/375 |

OTHER PUBLICATIONS

Notification of Transmittal of the Written Opinion of the International Searching Authority, or the Declaration; PCT/US2014/039071; Sep. 23, 2014; 10 pages.

* cited by examiner

HYDRAULIC SYSTEM AND METHOD OF ACTUATING A PLURALITY OF TOOLS

BACKGROUND

Hydraulic systems employ pressurized fluids to do work usually through moving pistons relative to cylinders. Circuits of conduits such as pipes, ports, tubes and hoses, for example, are positioned and configured to transport pressurized fluid to the desired locations. Applications in industries such as carbon dioxide sequestration and hydrocarbon recovery employ hydraulic systems to actuate tools positioned in earth formation boreholes that are thousands of feet below the surface of the earth. Although, the hydraulic systems currently employed serve their intended functions well, these industries are always receptive to new systems and methods that lower costs or reduce the number of conduits required.

BRIEF DESCRIPTION

Disclosed herein is a hydraulic system. The system includes a chemical injection line and a plurality of tools in operable communication with the chemical injection line that are independently responsive to changes in pressure or flow through the chemical injection line and that are configured to control flow of wellbore fluids.

Further disclosed herein is a hydraulic system that includes a chemical injection line and a plurality of tools in operable communication with the chemical injection line each of the plurality of tools are configured to be independently actuated by pressure supplied thereto through the chemical injection line to control the flow of wellbore fluids.

Further disclosed herein is a method of actuating a plurality of tools. The method includes, altering pressure in a chemical injection line, actuating at least one first of a plurality of tools in response to detecting a first selected pressure change profile in the chemical injection line, altering flow of wellbore fluids. Additionally, altering pressure in the chemical injection line further, actuating at least one second of the plurality of tools in response to detecting a second selected pressure change profile in the chemical injection line wherein whether or not chemical is injecting via the chemical injection line is not changed by the foregoing alterations in pressure in the chemical injection line, and altering flow of additional wellbore fluids.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
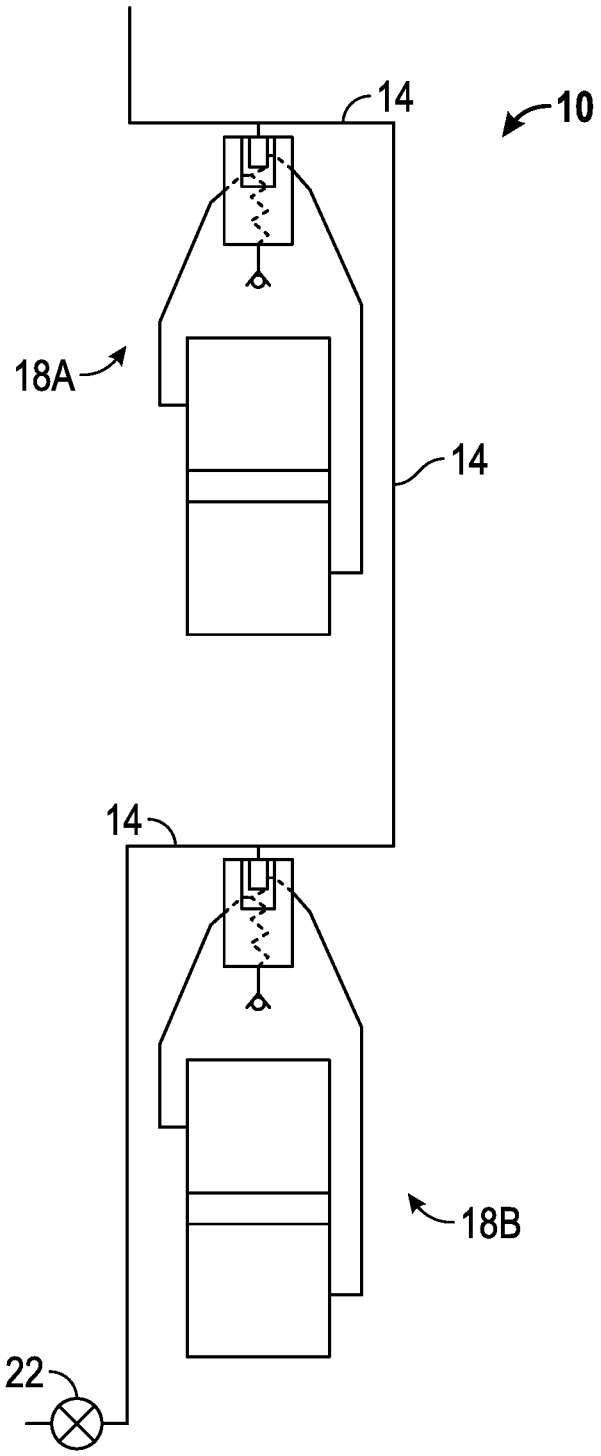
FIG. 1 depicts a partial schematic of an embodiment of a hydraulic system disclosed herein.

Referring to FIG. 1, an embodiment of a hydraulic system disclosed herein is illustrated at 10. The hydraulic system 10 includes a chemical injection line 14 fluidically connected to a plurality of tools 18A, 18B, with two of the tools 18A, 18B being illustrated in the Figure, although any practical number of the tools 18A, 18B could be employed in the hydraulic system 10. The tools 18A, 18B are configured to be actuated in response to changes in pressure or flow through the chemical injection line 14 and are configured to control flow of wellbore fluids, for example via actuation of a valve 20. The valve 20 can be an interval control valve, a safety valve, a barrier valve, or other valve for controlling flow of wellbore fluids, for example. Wellbore fluids include liquid fluids such as water, hydrocarbons and gases such as natural gas and carbon dioxide, for example that are retrievable from or pumpable into an earth formation.

In one embodiment each of the tools 18A, 18B is actuated by a different pressure level within the chemical injection line 14. For example the tool 18A actuates at a first pressure while the tool 18B actuates at a second pressure. As such, the tool 18A can be actuated independently of the tool 18B and all of the other tools 18X not shown. This includes actuating each of the tools 18A, 18B in any desired order regardless of their relative positions to one another. Additionally, by selecting the first pressure and the second pressure to be less than a third pressure wherein the third pressure is required to initiate injection of chemical through a chemical injection valve 22 in fluidic communication with the chemical injection line 14, the tools 18A, 18B can be actuated without altering whether or not chemical in the chemical injection line 14 is being injected. In this example the tools 18A, 18B are actuated while the chemical injection valve 22 remains closed. As such the pressure in the chemical line 14 is employed to do work without treating the wellbore and/or wellbore fluids in proximate the tools 18A, 18B. Alternately, by setting the first pressure and the second pressure above the third pressure the tools 18A, 18B can be actuated after chemical injection has begun by increasing flow through the chemical injection line 14 resulting in increasing of pressure in the line 14 until the first and second pressures are attained thereby actuating the tools 18A, 18B.

Additionally, in an embodiment disclosed herein one or more of the tools 18A, 18B is configured to have continuous actuational control thereof maintained through the chemical injection line 14. In such a device, for example, actuation of the one or more tools 18A, 18B is substantially reversible in response to a decrease in pressure in the chemical injection line 14. In essence the chemical injection line 14 is utilized as a closed loop hydraulic control circuit proximate the tool.

Figure 2:
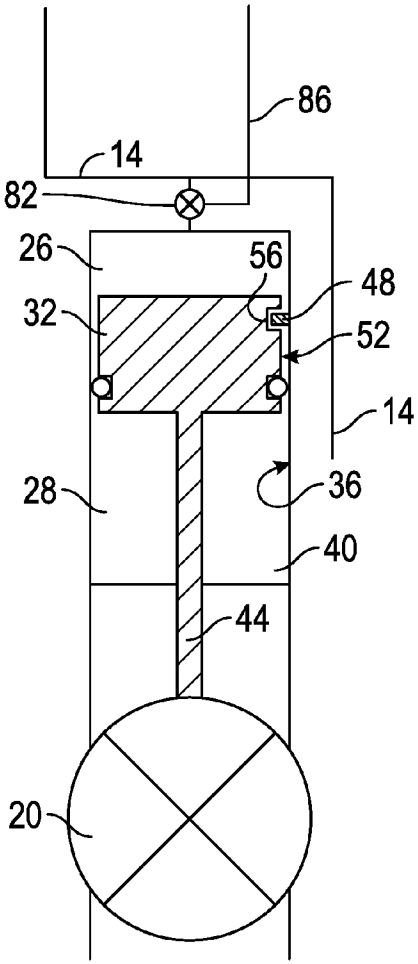
FIG. 2 depicts a schematic of a portion of a tool employed in the hydraulic system of FIG. 1.

An embodiment of a portion of the tools 18A, 18B is illustrated in detail in FIG. 2. The tools 18A, 18B include a first chamber 26 separated from a second chamber 28 by a piston 32 that is sealably engaged with walls 36 of the chambers 26, 28. Pressure from the chemical injection line 14 is supplied to the chamber 26 (assuming that optional control valve 82 discussed below is not present) while the chamber 28 is filled with a compressible fluid 40, such as air for example. Attached to the piston 32 is a rod 44 that is actuatably connected to a portion of the tools 18A, 18B. An operator, through sizing and pre-pressurizing the chamber 28 can selectively set the value of the first pressure at which the tools 18A, 18B actuate. In this embodiment the motive force for moving the piston 32 is provided by the pressurized fluid in the chemical injection line 14.

Alternately, a pin 48 extending from a wall 52 of the first chamber 26 can be functionally engaged in a J-slot 56 of the piston 32 to prevent actuation of the tools 18A, 18B until a pressure in the chemical injection line 14 has been increased above a selected pressure for a selected period of time followed by a drop below a selected pressure for a selected period of time and repeated to advance the pin 48 within the J-slot 56. In so doing an embodiment of the tools 18A, 18B is configured to be actuated only after a pressure profile defined as a selected series of pressure pulses in the chemical injection line 14 has been carried out. It should be pointed out that, as discussed above, the changes in pressure could be in response to changes in flow of fluid through a restriction (not shown) within the chemical injection line 14 for systems wherein chemical is allowed to flow prior to actuation of the tools 18A, 18B.

Figure 3:
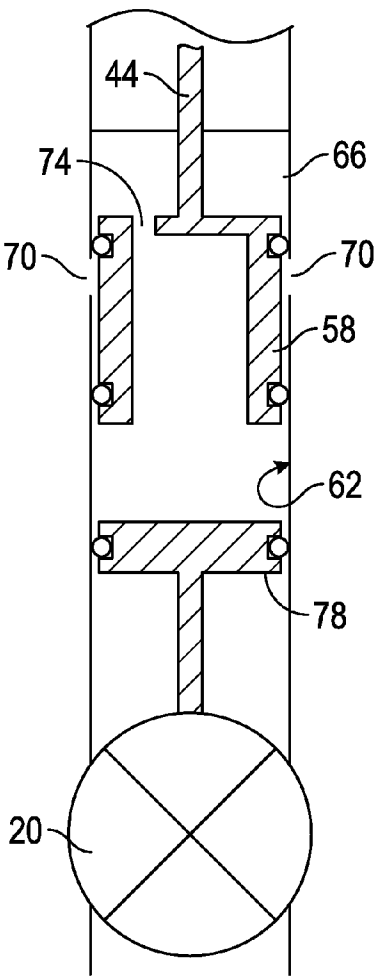
FIG. 3 depicts a schematic of a portion of a tool employed in an alternate embodiment of the hydraulic system of FIG. 1.

An alternate embodiment of a portion of the tools 18A, 18B is illustrated in detail in FIG. 3. The rod 44, as shown in FIG. 2 instead of connecting to valve 20 directly, instead connects to a sleeve 58 slidably sealingly engaged with walls 62 of a chamber 66. The walls 62 have windows 70 that fluidically connect the inside of the chamber 66 with the outside of the chamber 66 when not occluded by the sleeve 58. An opening 74 in the sleeve 58 allows fluid to flow longitudinally through the sleeve 58. Thus when the sleeve 58 is moved, for example, in response to pressure moving the piston 32 to remove occlusion of the opening 70 pressure outside of the chamber 66 is allowed into the chamber 66 where it can act on a second piston 78 and provide motive force thereto in causing the second piston 78 to move and thereby actuate the tools 18A, 18B. In an application such as downhole in an earth formation borehole, for example, pressure outside of the chamber 66 may be hydrostatic pressure that is based on the distance that the tools 18A, 18B are below surface. The foregoing allows changes in pressure within the chemical injection line 14 to initiate actuation of the tools 18A, 18B without directly actuating the tools 18A, 18B with pressure within the line 14. A linkage 79 from the piston 78, in this embodiment, connects to the valve 20, discussed above, that is actuated by movement of the piston 78.

Referring again to FIG. 2, yet another alternate embodiment of the tools 18A, 18B is illustrated. The tools 18A, 18B of this embodiment include an optional control valve 82 that selectively fluidically connects the chemical injection line 14 with the first chamber 26. The control valve 82 is operated via means other than pressure or fluid flow through the chemical injection line 14. In this embodiment a control line 86, connected to the control valve 82, controls operation of the control valve 82. The control line 86 can be an electric wire, a fiber optic cable or other line configured to communicate a signal to the control valve 82 from a remote location such as from surface in an application wherein the tools are in a borehole of an earth formation, for example. In this embodiment, pressure in the chemical injection line 14 is maintained above a pressure that is needed to move the piston 32 to actuate the tools 18A, 18B. Actuation of the tools 18A, 18B is controlled via signals supplied to the control valve 82 through the control line 86. The control valve 82 can for example include an electro-mechanical device such as a solenoid (not shown) configured to open the control valve 82 when a selected signal is received at the control valve 82 via the control line 86.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A hydraulic system comprising:

a chemical injection line;

a plurality of tools in operable communication with the chemical injection line and in fluid communication with wellbore fluids such that a change in a condition of one or more of the plurality of tools affects a flow of wellbore fluids, wherein the plurality of tools are independently responsive to distinct changes in pressure or flow through the chemical injection line and are configured to control flow of wellbore fluids; and, a chemical injection valve fluidically connected to the chemical injection line and independently responsive to distinct changes in pressure or flow through the chemical injection line.

2. The hydraulic system in claim 1, wherein the controlled wellbore fluids are comprised of fluids and gases produced from an earth formation.

3. The hydraulic system in claim 1, wherein the chemical is utilized to do work in the plurality of tools and is not used for treatment of the wellbore and/or wellbore fluids and gases proximate to the plurality of tools.

4. The hydraulic system in claim 1, wherein the chemical injection line is utilized as a closed loop hydraulic control circuit proximate to the plurality of tools.

5. The hydraulic system of claim 1, wherein the plurality of tools are actuated without altering whether chemicals are being injected via the chemical injection line.

6. The hydraulic system of claim 1, wherein the plurality of tools are configured to actuate while chemical is not being injected through the chemical injection valve.

7. The hydraulic system of claim 1, wherein the selected changes in pressure includes pressure pulses.

8. The hydraulic system of claim 1, further comprising a pressure source separate from the chemical injection line, wherein initiation of actuation includes using pressure from the chemical injection line, and the pressure source is accessible by the plurality of tools as a motive force to operate the plurality of tools after initiation of actuation.

9. The hydraulic system of claim 1, wherein the plurality of tools are actuated via motive force supplied through pressurized fluid in the chemical injection line.

10. The hydraulic system of claim 1, wherein each of the plurality of tools requires a unique profile of selected changes in pressure in the chemical injection line before actuation thereof can be completed.

11. The hydraulic system of claim 1, wherein the plurality of tools being independently responsive includes having actuational control thereof be maintained via pressure in or flow through the chemical injection line.

12. The hydraulic system of claim 1, wherein the plurality of tools are selected from the group consisting of an interval control valve, a safety valve and a barrier valve.

13. A hydraulic system comprising:

a chemical injection line; and a plurality of tools in operable communication with the chemical injection line, wherein the plurality of tools are independently responsive to changes in pressure or flow through the chemical injection line and are configured to control flow of wellbore fluids wherein initiation of actuation includes removing occlusion of an opening of the plurality of tools to allow flow therethrough and wherein the opening allows hydrostatic fluid to flow therethrough once opened.

14. The hydraulic system of claim 13, wherein motive forces to actuate the plurality of tools is provided by the hydrostatic fluid.

15. A hydraulic system comprising:

a chemical injection line; and a plurality of tools in operable communication with the chemical injection line and in fluid communication with wellbore fluids such that a change in a condition of one or more of the plurality of tools affects a flow of wellbore fluids, wherein the plurality of tools are configured to be independently actuated by distinct pressure supplied thereto through the chemical injection line and are configured to control the flow of wellbore fluids, at least one of the plurality of tools including a valve that allows pressure from the chemical injection line to act upon an actuator of the at least one of the plurality of tools once the valve has opened;

wherein initiation of actuation of the at least one of the plurality of tools is in response to signals received by the valve of the at least one of the plurality of tools, the signals not supplied via the chemical injection line.

16. The hydraulic system in claim 15, wherein the controlled wellbore fluids are comprised of fluids and gases produced from an earth formation.

17. The hydraulic system in claim 15, wherein the chemical is utilized to do work in the plurality of tools and is not used for treatment of the wellbore and/or wellbore fluids and gases proximate the plurality of tools.

18. The hydraulic system in claim 15, wherein the chemical injection line is utilized as a closed loop hydraulic control circuit proximate the plurality of tools.

19. The hydraulic system of claim 15, wherein the signals are at least one of electrical and optical.

20. The hydraulic system of claim 15, wherein at least one of the plurality of tools includes a solenoid.

21. The hydraulic system of claim 15, wherein each of the plurality of tools is configured to have actuational control thereof maintained by pressure supplied thereto through the chemical injection line.

22. A method of actuating a plurality of tools, comprising:

altering pressure in a chemical injection line operably connected to the plurality of tools;

actuating at least one first of the plurality of tools in response to a first selected pressure change profile in the chemical injection line;

altering flow of wellbore fluids with the at least one first of the plurality of tools;

altering pressure in the chemical injection line further;

actuating at least one second of the plurality of tools in response to a second selected pressure change profile in the chemical injection line wherein the foregoing alterations in pressure in the chemical injection line occur without affecting whether or not chemical is being injected via the chemical injection; and altering flow of additional wellbore fluids with the at least one second of the plurality of tools.

23. The method of actuating a plurality of tools of claim 22, further comprising actuating a plurality of the plurality of tools independently of one another.

24. The method of actuating a plurality of tools of claim 22, further comprising actuating at least one of the first of the plurality of tools and the second of the plurality of tools with motive force provided by the pressure in the chemical injection line.

25. The method of actuating a plurality of tools of claim 22, wherein the actuating at least one first of the plurality of tools includes opening a valve to allow fluid under hydrostatic pressure to provide a motive force to actuate a portion of the at least one first of the plurality of tools.

26. The method of actuating a plurality of tools of claim 22, further comprising reversing actuation of the at least one first of a plurality of tools in response to a third selected pressure change profile being detected in the chemical injection line.

* * * * *